US012392212B2

(12) United States Patent
Vasques

(10) Patent No.: US 12,392,212 B2
(45) Date of Patent: Aug. 19, 2025

(54) ANNULAR BARRIER

(71) Applicant: Welltec Manufacturing Center Completions ApS, Esbjerg (DK)

(72) Inventor: Ricardo Reves Vasques, Zug (CH)

(73) Assignee: Welltec Manufacturing Center Completions ApS, Esbjerg (DK)

( * ) Notice: Subject to any disclaimer, the term of this patent is extended or adjusted under 35 U.S.C. 154(b) by 217 days.

(21) Appl. No.: 17/854,362

(22) Filed: Jun. 30, 2022

(65) Prior Publication Data

US 2023/0003097 A1 Jan. 5, 2023

(30) Foreign Application Priority Data

Jun. 30, 2021 (EP) ..... 21182651
Jun. 22, 2022 (EP) ..... 22180565

(51) Int. Cl.
*E21B 33/124* (2006.01)
*E21B 33/12* (2006.01)
*E21B 33/122* (2006.01)

(52) U.S. Cl.
CPC ..... *E21B 33/1243* (2013.01); *E21B 33/1208* (2013.01); *E21B 33/122* (2013.01)

(58) Field of Classification Search
CPC .. E21B 33/06; E21B 33/1243; E21B 33/1208; E21B 33/122; E21B 33/128; F16J 15/08; F16J 15/02
See application file for complete search history.

(56) References Cited

U.S. PATENT DOCUMENTS 2,714,932 A * 8/1955 Thompson ..... E21B 33/1293 166/138
3,554,280 A * 1/1971 Tucker ..... E21B 33/1208 166/134

(Continued)

FOREIGN PATENT DOCUMENTS

EP 2586963 5/2013
WO 2018/029456 2/2018

OTHER PUBLICATIONS

Extended Search Report for EP21182651.6 dated Oct. 13, 2021, 7 pages.

*Primary Examiner* — Gilbert Y Lee
(74) *Attorney, Agent, or Firm* — Nixon & Vanderhye P.C.

(57) ABSTRACT

The present invention relates to an annular barrier for providing zonal isolation in an annulus downhole between a well tubular metal structure and another well tubular metal structure or a wall of a borehole, comprising a tubular metal part configured to be mounted as part of the well tubular metal structure, the tubular metal part having an outer face, an opening and an axial extension along the well tubular metal structure, and an expandable metal sleeve surrounding the tubular metal part, the first expandable metal sleeve having a circumferential groove, a first end and a second end, each end of the expandable metal sleeve being connected with the outer face of the tubular metal part, wherein the annular barrier further comprises an anchoring element arranged in the circumferential groove, the anchoring element comprising a first anchoring part at least partly overlapping a second anchoring part in a radial direction perpendicular to the axial extension so that an inner face of the first anchoring part at least partly abuts an outer face of the second anchoring part. Moreover, the present invention relates to a downhole completion system.

14 Claims, 8 Drawing Sheets

(56) References Cited

U.S. PATENT DOCUMENTS

Figure 1:
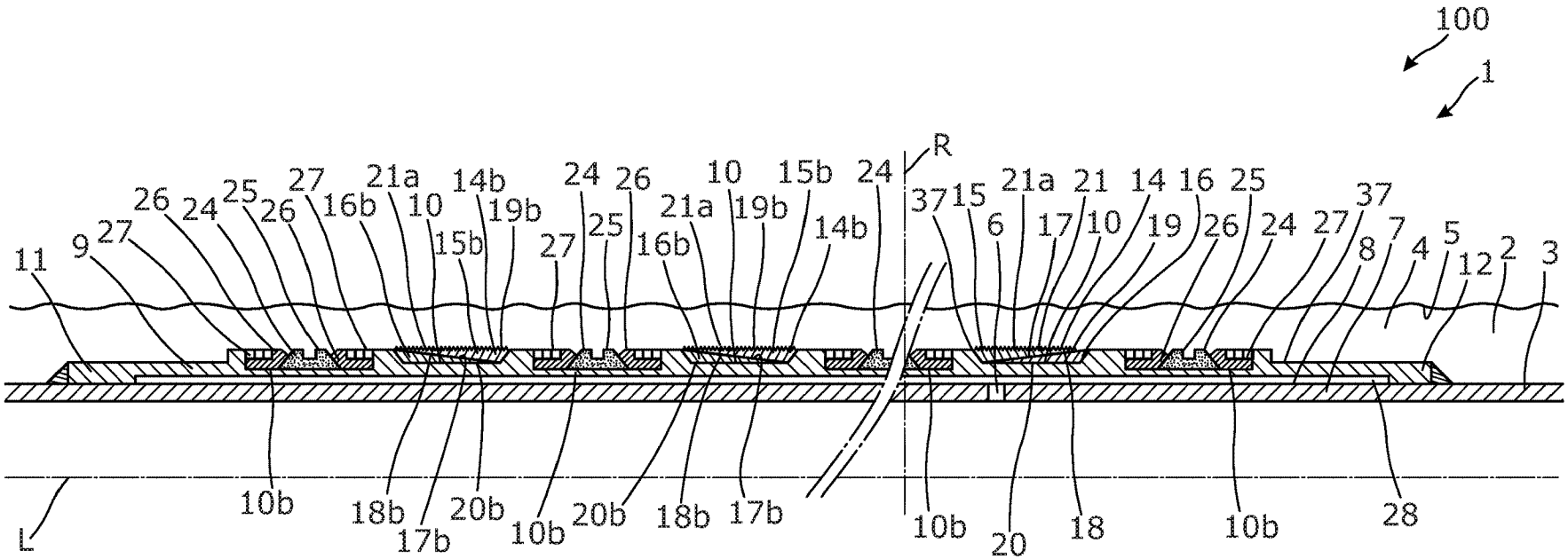

| | | | | |
|---|---|---|---|---|
| 4,942,925 | A | 7/1990 | Themig | |
| 8,276,678 | B2 * | 10/2012 | Burnett | E21B 33/1216 277/342 |
| 8,746,352 | B2 * | 6/2014 | Shaw | F16J 15/3236 166/368 |
| 10,125,567 | B2 | 11/2018 | Martin et al. | |
| 2003/0226668 | A1 * | 12/2003 | Zimmerman | E21B 33/1204 166/134 |
| 2019/0383114 | A1 | 12/2019 | Vasques | |
| 2020/0165892 | A1 | 5/2020 | Vasques et al. | |

* cited by examiner

ANNULAR BARRIER

This application is the U.S. claims priority to EP patent application Ser. No. 21/182,651.6 filed Jun. 30, 2021, and EP patent application Ser. No. 22/180,565.8 filed Jun. 22, 2022, the entire contents of each of which are hereby incorporated by reference.

The present invention relates to an annular barrier for providing zonal isolation in an annulus downhole between a well tubular metal structure and another well tubular metal structure or a wall of a borehole. Moreover, the present invention relates to a downhole completion system.

Annular barriers are used downhole for providing isolation of one zone from another in an annulus in a borehole of a well between a well tubular metal structure and the borehole wall or another well tubular metal structure. When the annular barrier has been set, e.g. when an expandable metal sleeve has been expanded, the temperature may vary. Thus, the well tubular metal structure with annular barriers will increase in length if the temperature increases, and likewise the length of the well tubular metal structure will decrease if the temperature decreases, e.g. the temperature will decrease during fracturing with sea water. During such length variations, the axial load on the expandable metal sleeve will vary, and tests have shown that the annular barriers cannot withstand a high axial load when the differential pressure across the expandable metal sleeve is low, i.e. when the pressure inside the annular barrier is low compared to the pressure in the annulus.

It is an object of the present invention to wholly or partly overcome the above disadvantages and drawbacks of the prior art. More specifically, it is an object to provide an improved annular barrier able to withstand a higher axial load than known annular barriers when the differential pressure across the expandable metal sleeve of the annular barrier is low.

The above objects, together with numerous other objects, advantages and features, which will become evident from the below description, are accomplished by a solution in accordance with the present invention by an annular barrier for providing zonal isolation in an annulus downhole between a well tubular metal structure and another well tubular metal structure or a wall of a borehole, comprising:

- a tubular metal part configured to be mounted as part of the well tubular metal structure, the tubular metal part having an outer face, an opening and an axial extension along the well tubular metal structure, and
- an expandable metal sleeve surrounding the tubular metal part, the first expandable metal sleeve having a circumferential groove, a first end and a second end, each end of the expandable metal sleeve being connected with the outer face of the tubular metal part,
- wherein the annular barrier further comprises an anchoring element arranged in the circumferential groove, the anchoring element comprising a first anchoring part at least partly overlapping a second anchoring part in a radial direction perpendicular to the axial extension so that an inner face of the first anchoring part at least partly abuts an outer face of the second anchoring part.

In addition, the anchoring element may be a circumferential anchoring element.

Moreover, the inner face of the first anchoring part and the outer face of the second anchoring part may be inclined in relation to the axial extension.

By having the inner face of the first anchoring part and the outer face of the second anchoring part inclined in relation to the axial extension, it is obtained that when at least part of the expandable metal sleeve moves in one direction along the axial direction, the first anchoring part moves in an opposite direction along the inclined outer face of the second anchoring part, and the first anchoring part is then forced radially outwards, anchoring the expandable metal sleeve even further to another well tubular metal structure or the wall of the borehole.

Furthermore, the first anchoring part and the second anchoring part may be one monolithic whole.

Additionally, the first anchoring part and the second anchoring part may be one monolithic whole, the first anchoring part and the second anchoring part forming a key ring where the first anchoring part is one end of the key ring, and the second anchoring part is the other end of the key ring.

Also, the first anchoring part may form one monolithic whole, the second anchoring part forming a second monolithic whole.

Further, the first anchoring part may be shaped as a first slit ring, the second anchoring part being shaped as a second slit ring. Thus, the first anchoring part may comprise slits.

In addition, the anchoring element may further comprise a fixation unit being arranged in the groove of the first anchoring part.

Furthermore, the fixation unit may comprise a ring-shaped part extending all the way around the expandable metal sleeve, each end of the ring-shaped part being connected with a breakable element.

Additionally, the ring-shaped part may be a sealing element where each end of the sealing element is connected in at least one connection part.

Moreover, the breakable element may be a pin extending through the at least one connection part and into the first anchoring part.

In addition, the first anchoring part may comprise a groove into which both a sealing element and a fixation element are arranged.

Further, the first anchoring part may comprise two grooves into which a sealing element is arranged in one of the grooves, and a fixation element is arranged in the other groove.

Also, the first anchoring part may comprise at least one groove having a trapeze cross-sectional shape along the axial extension.

Additionally, the groove may have a first length along the axial extension, and the first anchoring part may have a second length along the axial extension, where the first length is at least 10% of the second length, and preferably at least 20% of the second length.

Moreover, the annular barrier may further comprise a connection element arranged between the tubular metal part and the expandable metal sleeve, and the connection element may be connected with the tubular metal part and the expandable metal sleeve.

In addition, the expandable metal sleeve may be divided into at least two parts, and each part may be connected to the connection element.

Further, the connection element may be arranged opposite the circumferential groove.

Moreover, the first anchoring part may further comprise an outer face, the second anchoring part comprising an inner face, and the outer face of the first anchoring part comprising friction-enhancing means and facing another well tubular metal structure or the wall of the borehole.

In addition, the friction-enhancing means may be spikes or grooves.

Also, the outer face of the first anchoring part may have at least one groove in which a spring element or a sealing element is arranged.

Furthermore, the inner face of the second anchoring part may have at least one groove in which a spring element or a sealing element is arranged.

Additionally, the inner face of the first anchoring part and the outer face of the second anchoring part may have lower friction between them than that between the inner face of the second anchoring part and the circumferential groove.

Moreover, the inner face of the second anchoring part may have at least one groove in which a spring element or a sealing element is arranged.

Also, the sealing element may be ring-shaped with a trapeze cross-sectional shape.

In addition, the anchoring element may comprise a third anchoring part having an outer face abutting a second inner face of the first anchoring part, so that the first anchoring part is arranged between the third anchoring part and the second anchoring part, and the inner face of the third anchoring part and the inner face of the second anchoring part face and abut the circumferential groove.

Further, the outer face of the third anchoring part may be inclined in an opposite direction, i.e. a direction opposite to that of the outer face of the second anchoring part.

Also, the second inner face of the first anchoring part may be inclined, thus corresponding to the inclined outer face of the third anchoring part.

According to the present invention, the annular barrier may further comprise a second anchoring element comprising a first anchoring part at least partly overlapping a second anchoring part in a radial direction perpendicular to the axial extension so that an inner face of the first anchoring part at least partly abuts an outer face of the second anchoring part, the inner face of the first anchoring part and the outer face of the second anchoring part being inclined in relation to the axial extension in an opposite direction, i.e. a direction opposite to that of the first anchoring element.

Thus, the inner face of the first anchoring part of the first anchoring element may be inclined facing upwards towards the top of the well, the inner face of the first anchoring part of the second anchoring element being inclined facing downwards away from the top of the well. By having a first anchoring element with an inclined inner face of the first anchoring part in one direction and a second anchoring element with an inclined face of the first anchoring part in an opposite direction, the annular barrier can withstand axial loads in both directions along the axial extension as the first anchoring element is activated when the axial load is in one direction, and the second anchoring element is activated when the axial load pulls in the opposite direction.

Furthermore, the first anchoring element and the second anchoring element may be arranged in the same circumferential groove.

Also, the expandable metal sleeve may have a second circumferential groove in which a sealing unit is arranged.

Additionally, the sealing unit may comprise a sealing element made of e.g. elastomer.

Moreover, the sealing unit may further comprise a back-up ring-shaped element and a key ring element.

Furthermore, the expandable metal sleeve may comprise at least two sealing units, the anchoring element being arranged between two sealing units.

Finally, the present invention also relates to a downhole completion system comprising an annular barrier and a well tubular metal structure.

Figure 2:
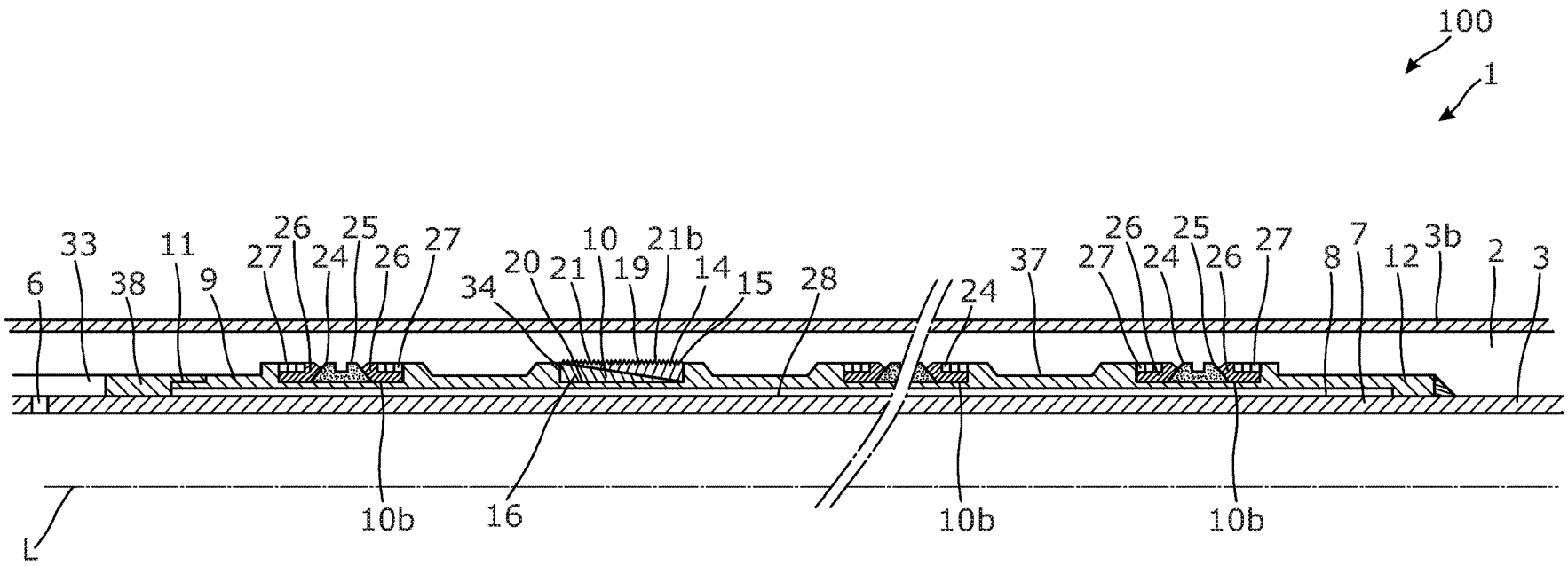
Figure 3:
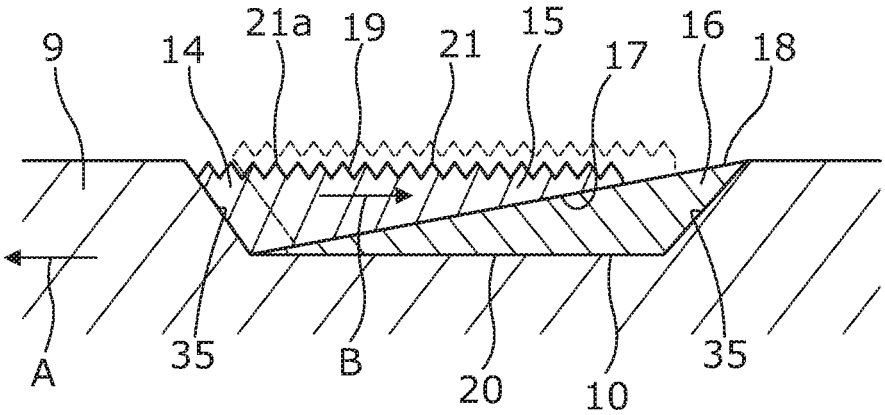
Figure 4:
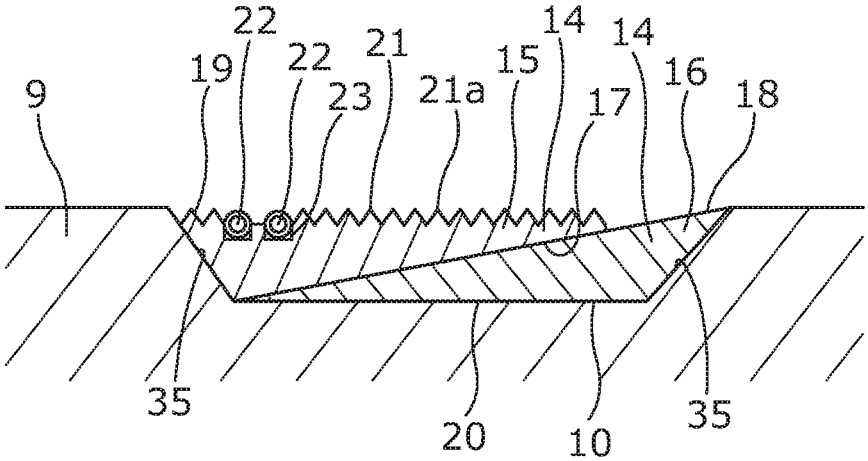
Figure 5:
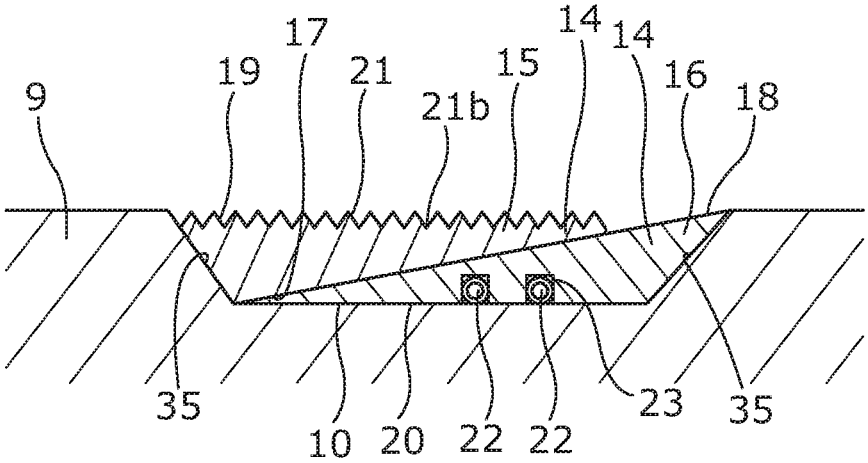
Figure 6:
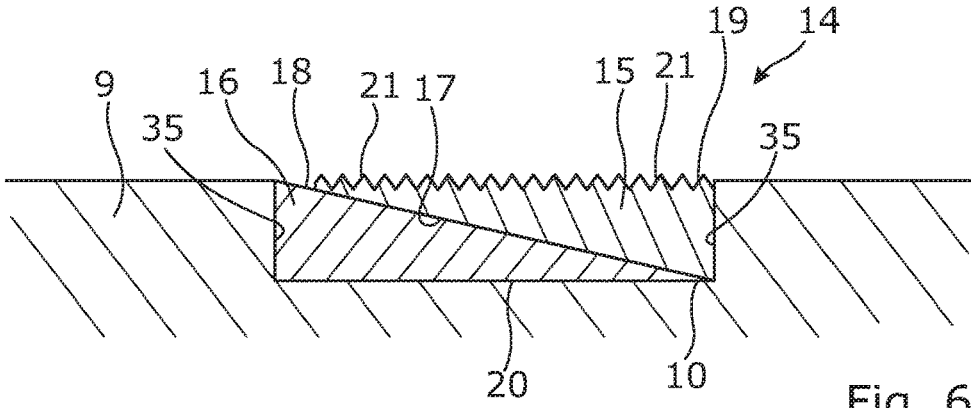
Figure 7:
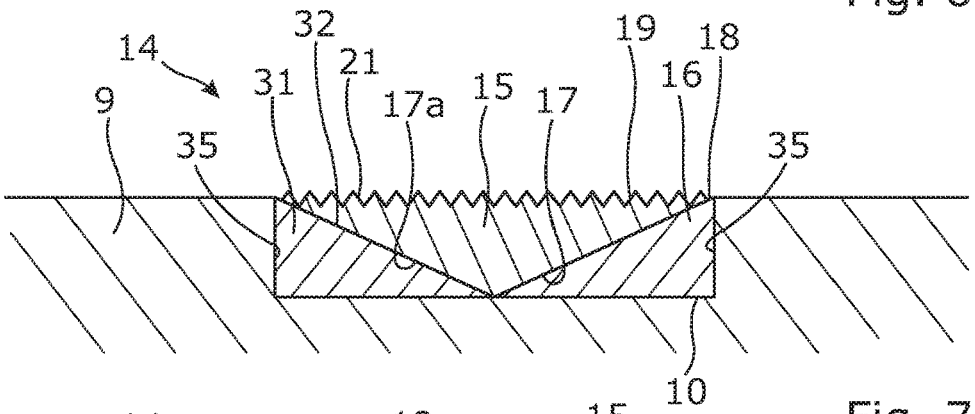
Figure 8:
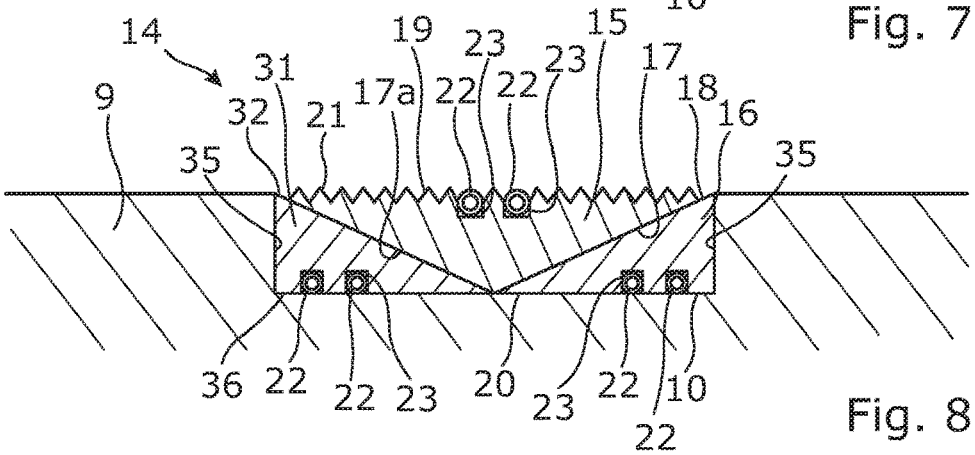
Figure 9:
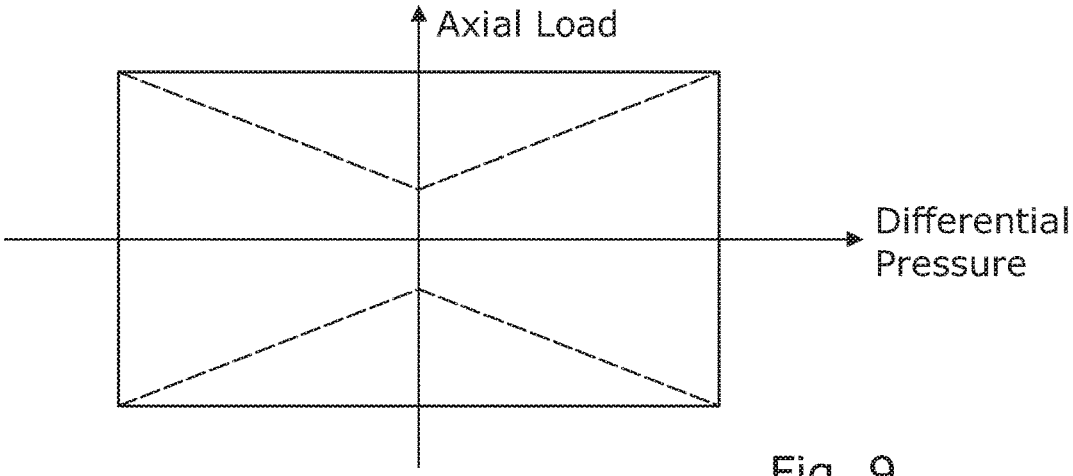
Figure 10:
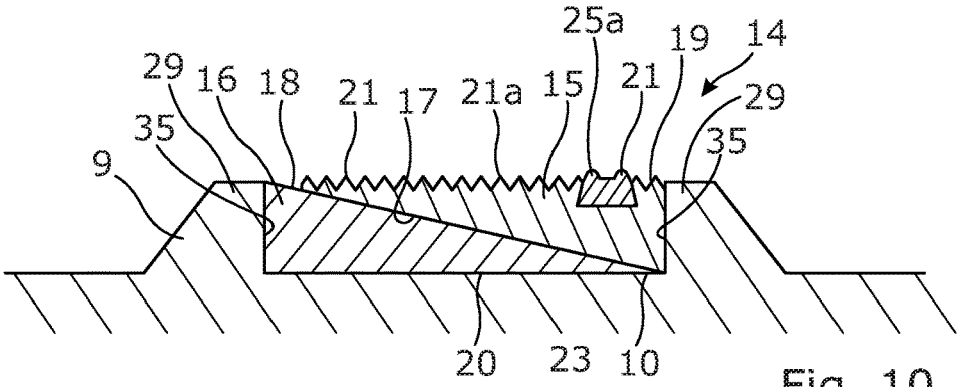
Figure 11:
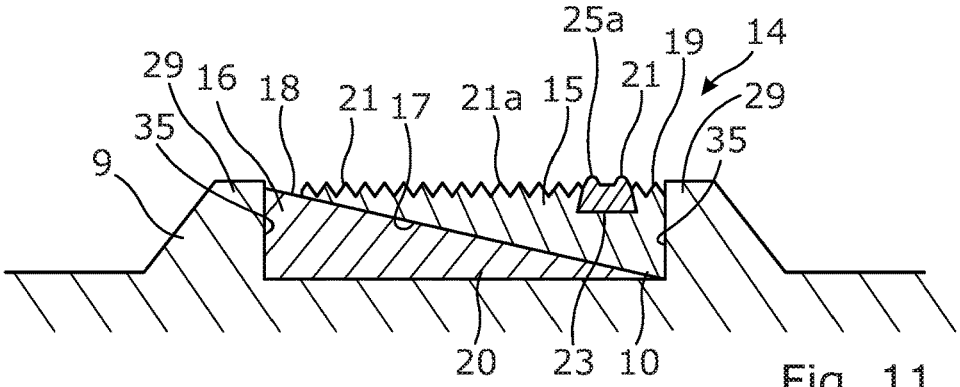
Figure 12:
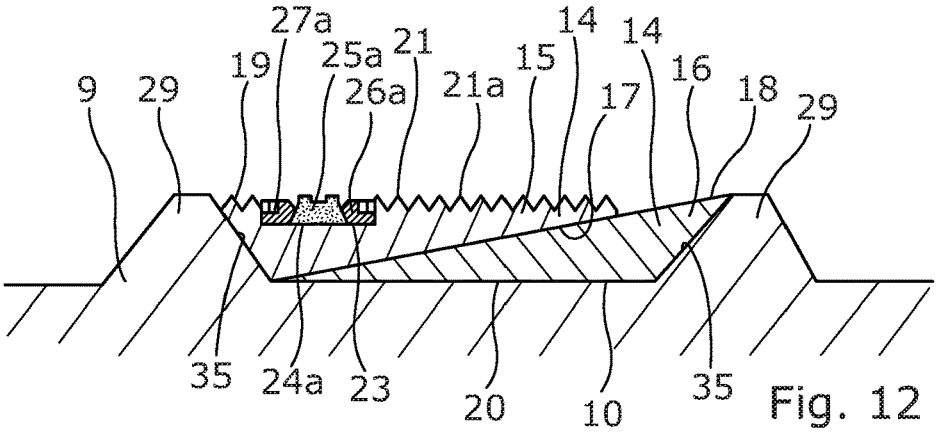
Figure 13:
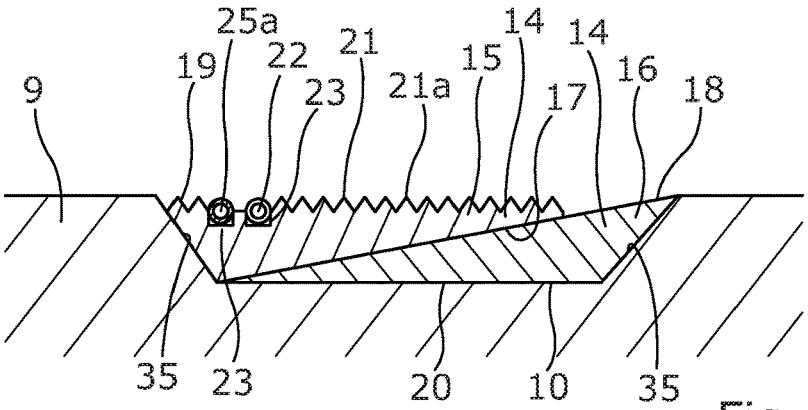
Figure 14:
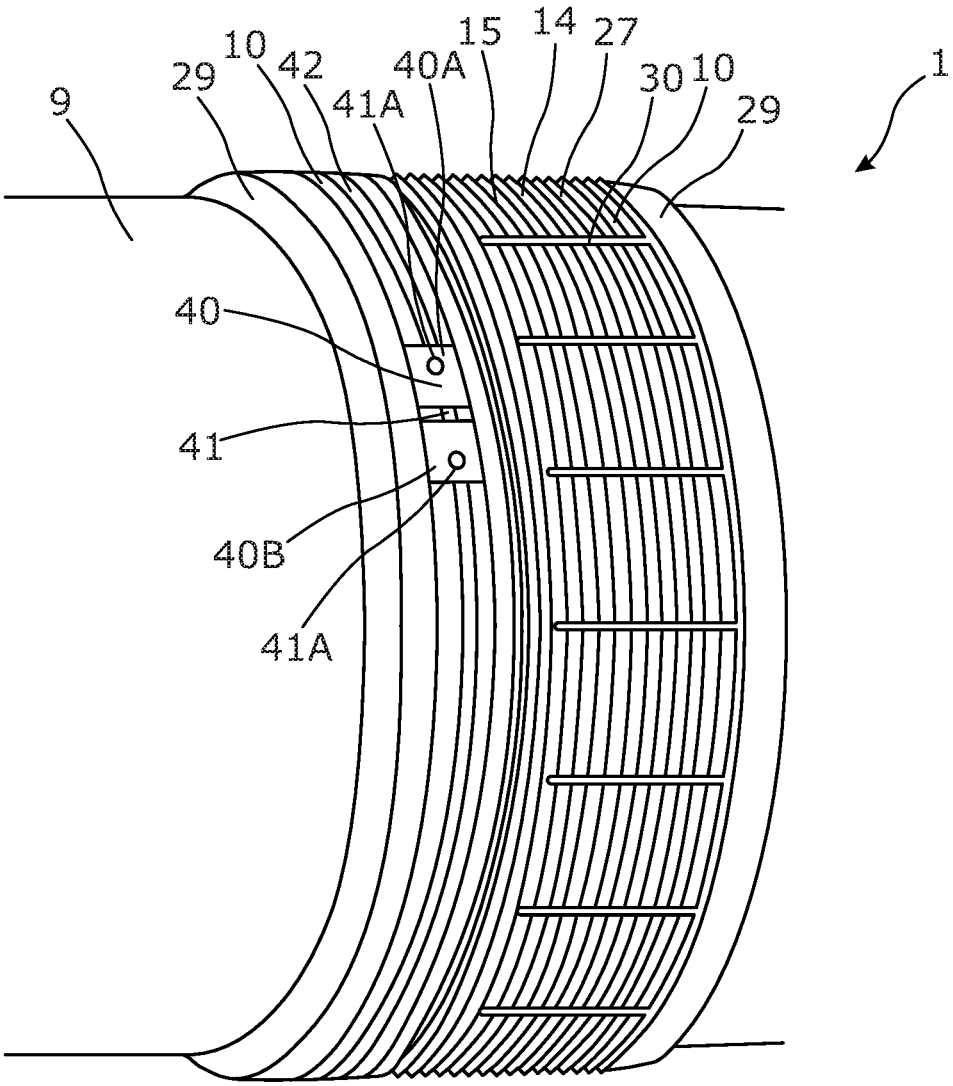
Figure 15:
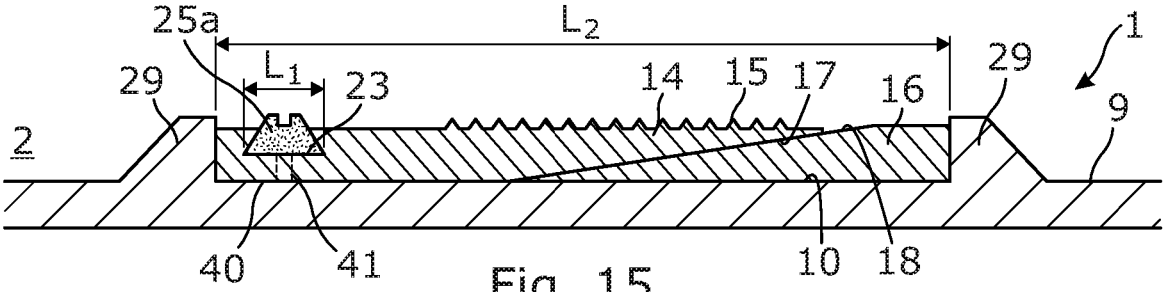
Figure 16:
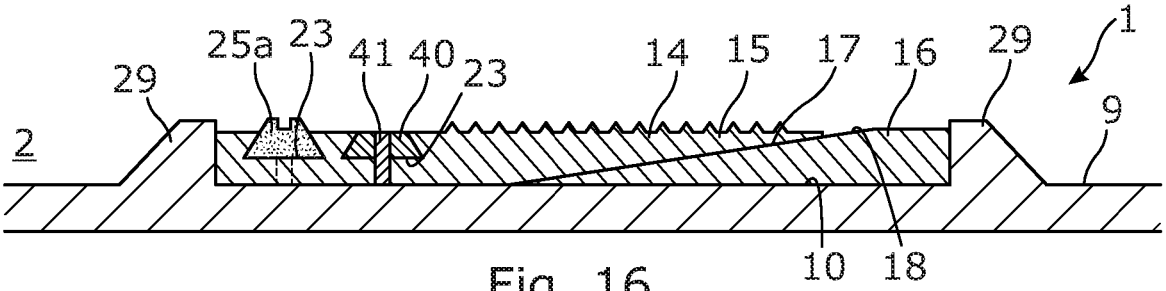
Figure 17:
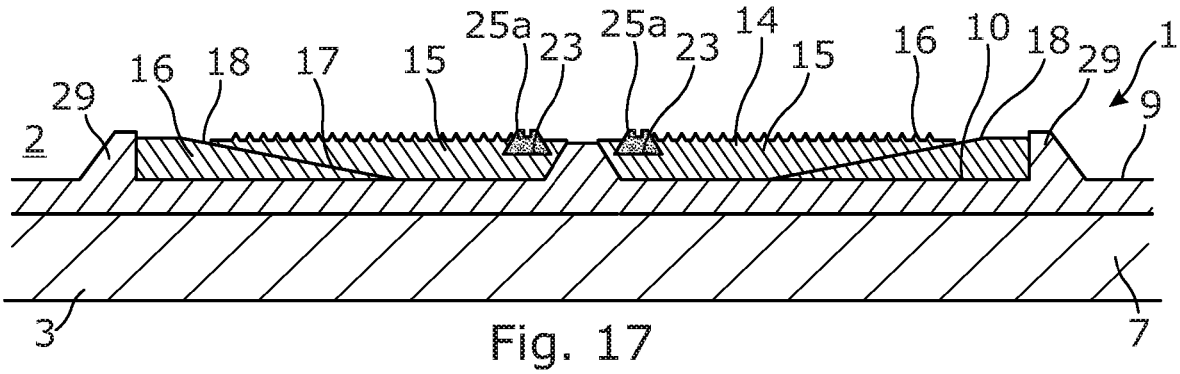
Figure 18A:
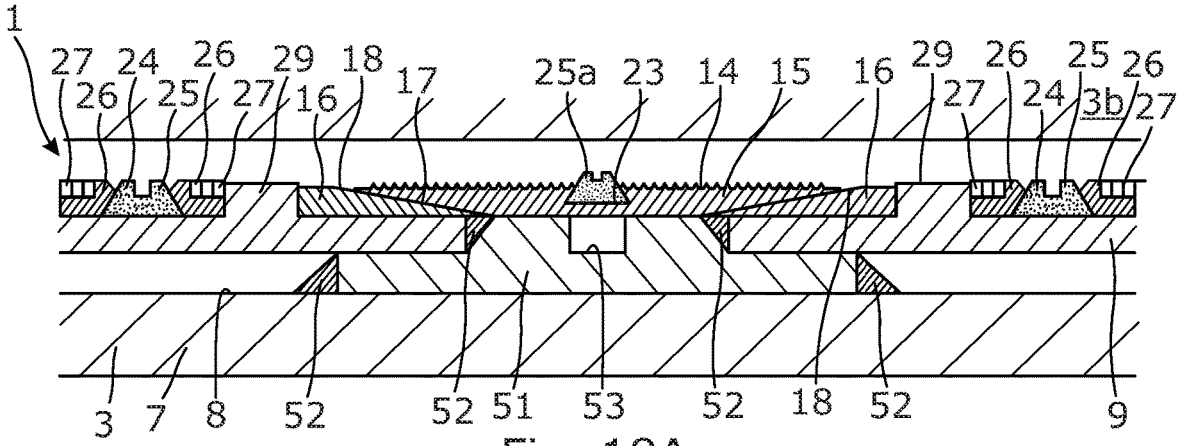
Figure 18B:
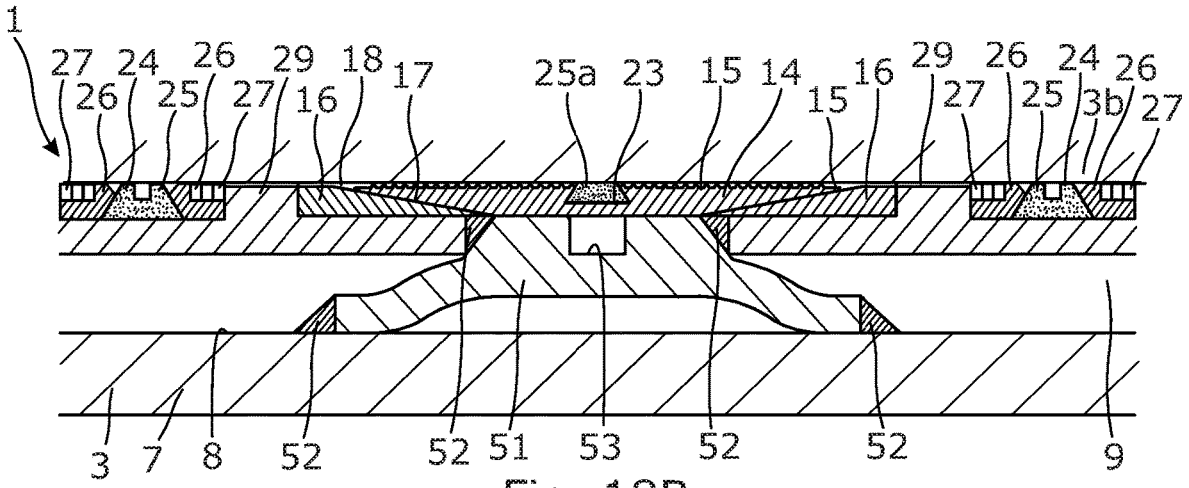

The invention and its many advantages will be described in more detail below with reference to the accompanying schematic drawings, which for the purpose of illustration show some non-limiting embodiments and in which:

FIG. 1 shows a cross-sectional view of an annular barrier having sealing units and anchoring elements, FIG. 2 shows a cross-sectional view of another annular barrier having an anchoring element, FIG. 3 shows a cross-sectional view of part of an expandable metal sleeve having a groove in which an anchoring element is arranged, FIG. 4 shows a cross-sectional view of part of another expandable metal sleeve having a groove in which another anchoring element with springs is arranged, FIG. 5 shows a cross-sectional view of part of another annular barrier having a groove in the expandable metal sleeve in which another anchoring element with springs is arranged, FIG. 6 shows a cross-sectional view of part of another expandable metal sleeve having a groove in which another anchoring element with an inclination in an opposite direction of the anchoring element shown in FIG. 3 is arranged, FIG. 7 shows a cross-sectional view of part of yet another expandable metal sleeve having a groove in which another anchoring element comprises a first, second and third anchoring part, FIG. 8 shows a cross-sectional view of part of yet another expandable metal sleeve having a groove in which another anchoring element comprises a first, second and third anchoring part and springs in each of the parts, FIG. 9 is a schematic diagram of the axial load on an annular barrier in relation to differential pressure across the expandable metal sleeve, FIG. 10 shows a cross-sectional view of part of another expandable metal sleeve having a groove in which another anchoring element with a sealing element is arranged, FIG. 11 shows a cross-sectional view of part of yet another expandable metal sleeve having a groove in which another anchoring element with a sealing element is arranged, FIG. 12 shows a cross-sectional view of part of yet another expandable metal sleeve having a groove in which another anchoring element with a sealing unit is arranged, FIG. 13 shows a cross-sectional view of part of yet another expandable metal sleeve having a groove in which another anchoring element with both a spring and a sealing element is arranged, FIG. 14 shows a perspective of part of an annular barrier having another anchoring element, FIG. 15 shows a cross-sectional view of part of yet another expandable metal sleeve having an anchoring element with a fixation element incorporated in the sealing unit, FIG. 16 shows a cross-sectional view of part of yet another expandable metal sleeve having an anchoring element with a fixation element and a separate sealing unit, FIG. 17 shows a cross-sectional view of part of yet another expandable metal sleeve having a groove in which two opposite-facing anchoring elements are arranged, FIG. 18A shows a cross-sectional view of part of yet another unexpanded expandable metal sleeve having a groove in which an anchoring element comprising two second anchoring parts is arranged, and FIG. 18B shows the expandable metal sleeve of FIG. 18A in an expanded condition.

All the figures are highly schematic and not necessarily to scale, and they show only those parts which are necessary in order to elucidate the invention, other parts being omitted or merely suggested.

FIG. 1 shows a cross-sectional view of an annular barrier 1 in an unexpanded condition for providing zonal isolation in an annulus 2 downhole between a well tubular metal structure 3 and another well tubular metal structure 3*b*, as shown in FIG. 2, or a wall 5 of a borehole 4, as shown in FIG. 1. The annular barrier 1 comprises a tubular metal part 7 mounted as part of the well tubular metal structure 3. The tubular metal part 7 has an outer face 8, an opening 6 and an axial extension L along the well tubular metal structure 3. The annular barrier 1 comprises an expandable metal sleeve 9 surrounding the tubular metal part 7, where the first expandable metal sleeve 9 has a circumferential groove 10, a first end 11 and a second end 12, and each end of the expandable metal sleeve 9 is connected with the outer face 8 of the tubular metal part 7. The annular barrier 1 further comprises an anchoring element 14 arranged in the circumferential groove 10, the anchoring element 14 comprising a first anchoring part 15 at least partly overlapping a second anchoring part 16 in a radial direction perpendicular to the axial extension L so that an inner face 17 of the first anchoring part 15 at least partly abuts an outer face 18 of the second anchoring part 16. The anchoring element 14 is a circumferential anchoring element extending all the way around the expandable metal sleeve 9, and the anchoring element 14 may be slit so that the anchoring element 14 can be mounted in the circumferential groove 10.

In order to provide increased anchoring during axial load, the inner face 17 of the first anchoring part 15 and the outer face 18 of the second anchoring part 16 are inclined in relation to the axial extension L. Thus, when the temperature changes, and at least part of the expandable metal sleeve 9 moves in one direction along the axial extension L, indicated with arrow A in FIG. 3, the first anchoring part 15 moves in an opposite direction along the inclined outer face 18 of the second anchoring part 16, as indicated with arrow B in FIG. 3, and the first anchoring part 15 is then forced radially outwards, as indicated with dashed lines in FIG. 3, anchoring the expandable metal sleeve 9 even further to another well tubular metal structure 3*b* (shown in FIG. 2) or the wall 5 of the borehole 4.

In the diagram of FIG. 9, the axial load on the annular barrier 1 as a function of the differential pressure is illustrated with full lines. By having an annular barrier 1 according to the invention with an anchoring element, the axial load is not reduced when the differential pressure is low as in prior art annular barriers, which is indicated by dotted lines.

In FIG. 1, the first anchoring part 15 forms one monolithic whole, and the second anchoring part 16 forms a second monolithic whole. The first anchoring part 15 is shaped as a first slit ring, and the second anchoring part 16 is shaped as a second slit ring so that it can be widened and thus be mounted in the circumferential groove 10. First, the second anchoring part 16 is widened and moved along an outer face 37 of the expandable metal sleeve 9 and into the circumferential groove 10, and then the first anchoring part 15 is widened and moved along the outer face 37 of the expandable metal sleeve 9 until reaching the circumferential groove 10 and being arranged circumferenting the second anchoring part 16, so that the inclined inner face 17 of the first anchoring part 15 and the inclined outer face 18 of the second anchoring part 16 abut.

The first anchoring part 15 further comprises an outer face 19 facing another well tubular metal structure 3*b*, as shown in FIG. 2, or the wall 5 of the borehole 4, as shown in FIG. 1, and the second anchoring part 16 comprises an inner face 20 facing and abutting the circumferential groove 10. The outer face 19 of the first anchoring part 15 comprises friction-enhancing means 21, such as spikes 21*a*, as shown in FIG. 1, and/or is provided with grooves 21*b*, as shown in FIG. 2.

In FIG. 1, the annular barrier 1 further comprises a second anchoring element 14*b* comprising a first anchoring part 15*b* having an outer face 19*b* and at least partly overlapping a second anchoring part 16*b* in a radial direction perpendicular to the axial extension L so that an inner face 17*b* of the first anchoring part 15*b* at least partly abuts an outer face 18*b* of the second anchoring part 16*b*. The inner face 17*b* of the first anchoring part 15*b* and the outer face 18*b* of the second anchoring part 16*b* are inclined in relation to the axial extension L in an opposite direction, i.e. a direction opposite to that of the first anchoring element 14. The first anchoring element 14 has inclined faces which when mirrored around a line R correspond to the inclined faces of the second anchoring element 14*b*. By having first anchoring elements 14 with inclined faces in one direction and second anchoring elements 14*b* with inclined faces in an opposite direction as shown in FIG. 1, the annular barrier 1 can withstand axial loads in both directions along the axial extension L as the first anchoring elements 14 are activated when the axial load is in one direction, and the second anchoring elements 14*b* are activated when the axial load pulls in the opposite direction.

The expandable metal sleeve 9 of the annular barrier 1 has a second circumferential groove 10*b* in which a sealing unit 24 is arranged. The sealing unit 24 comprises a sealing element 25, made of e.g. elastomer or polymer, a back-up ring-shaped element 26 on each side of the sealing element 25 and a key ring element 27 surrounding part of the back-up ring-shaped element 26. The expandable metal sleeve 9 comprises several sealing units 24, and each anchoring element 14, 14*b* is arranged between two sealing units 24.

In FIG. 2, the first anchoring part 15 and the second anchoring part 16 are one monolithic whole. The first anchoring part 15 and the second anchoring part 16 form a key ring 34, where the first anchoring part 15 is one end of the key ring 34, and the second anchoring part 16 is the other end of the key ring 34. The key ring 34 unwinds as the expandable metal sleeve 9 is expanding, and when expanded, the first anchoring part 15 will not fully overlap the second anchoring part 16 along the whole circumference of the expandable metal sleeve 9.

In FIG. 2, the expandable metal sleeve 9 has several grooves 10, 10*b*, and between these grooves other "empty" grooves are arranged so that the anchoring element 14, 14*b* and the sealing units 24 are arranged with the same distance between them along the axial extension L.

Each end of the expandable metal sleeve 9 is connected with the outer face 8 of the tubular metal part 7, e.g. by means of a connection part 38 and/or by welding as shown in FIG. 1. In FIG. 2, the annular barrier 1 further comprises a valve assembly 33 fluidly connected with the opening 6 and an expandable space 28 so as to fluidly connect the opening 6 and the expandable space 28 during expansion of the expandable metal sleeve 9 and close the fluid connection after the expandable metal sleeve 9 has been properly expanded. The valve assembly 33 may in the second position open for a fluid connection between the annulus 2 and the expandable space 28 in order to equalise the pressure therebetween.

In order to enhance the initial anchoring, the outer face 19 of the first anchoring part 15 has two grooves 23 in which a spring element 22 is arranged, as shown in FIG. 4. During expansion of the expandable metal sleeve 9, the spring elements 22 are compressed, and after the expansion has finalised, the spring elements 22 will slightly decompress due to the small "spring-back effect" following the expansion of metal. The spring elements 22 are thus always in contact with the wall 5 of the borehole 4, and when the axial load starts, the spring elements 22 will ensure that the first anchoring part 15 moves along the inclined outer face 18 of the second anchoring part 16, and thus the first anchoring part 15 will be forced radially outwards as illustrated by the dotted lines in FIG. 3. Another way is shown in FIG. 5, where the inner face 20 of the second anchoring part 16 has two grooves 23 in which the spring element 22 is arranged. When the spring elements 22 are arranged in the inner face 20, the spring elements 22 force both the second anchoring part 16 and the first anchoring part 15 outwards so that the first anchoring part 15 is in contact/engagement with the wall 5 of the borehole 4 or another well tubular metal structure 3*b*.

The inner face 17, 17*b* of the first anchoring part 15, 15*b* and the outer face 18, 18*b* of the second anchoring part 16, 16*b* have low friction between them so that no substantial force is lost in order for the anchoring parts to slide in relation to each other. Thus, the inner face 17, 17*b* of the first anchoring part 15, 15*b* and the outer face 18, 18*b* of the second anchoring part 16, 16*b* have lower friction between them than that between the inner face 20, 20*b* of the second anchoring part 16, 16*b* and the circumferential groove 10.

In FIGS. 3-5, the circumferential groove 10 has inclined end faces 35, and in FIGS. 6-8 the end faces 35 are perpendicular to the axial extension L. When having perpendicular end faces 35, as in FIGS. 6-8, the second anchoring part 16 is more restricted than in FIGS. 3-5. The inclined outer face 18 of the second anchoring part 16 ends at the top of the circumferential groove 10 so that the first anchoring part 15 is not restricted by the end faces 35 of the groove 10 and is thus not prevented from sliding further past the end of the outer face 18 of the second anchoring part 16 if needed.

In FIGS. 7 and 8, the anchoring element 14 of the annular barrier 1 comprises a third anchoring part 31 having an outer face 32 abutting a second inner face 17*a* of the first anchoring part 15, so that the first anchoring part 15 is arranged between the third anchoring part 31 and the second anchoring part 16, and an inner face 36 of the third anchoring part 31 and the inner face 20 of the second anchoring part 16 face and abut the circumferential groove 10. In FIG. 8, the outer face 19 of the first anchoring part 15 comprises two grooves 23 in which the spring element 22 is arranged, and both the inner face 20 of the second anchoring part 16 and the inner face 36 of the third anchoring part 31 comprise two grooves 23 in which the spring element 22 is arranged.

Another way of enhancing the initial anchoring is shown in FIGS. 10-13 in which the outer face 19 of the first anchoring part 15 has the groove 23 in which a sealing element 25*a* is arranged. The sealing element 25*a* is made of e.g. elastomer or polymer. During expansion of the expandable metal sleeve 9, the sealing element 25*a* is compressed, and after the expansion has finalised, the sealing element 25*a* will slightly decompress due to the small "spring-back effect" following the expansion of metal. The sealing element 25*a* is thus always in contact with the wall 5 of the borehole 4, and when the axial load starts, the sealing element 25*a* will ensure that the first anchoring part 15 moves along the inclined outer face 18 of the second anchoring part 16, and thus the first anchoring part 15 will be forced radially outwards as illustrated by the dotted lines in FIG. 3 and will provide sufficient anchoring to withstand the axial load. In FIG. 10, the expandable metal sleeve 9 comprises two projections 29 between which the circumferential groove 10 is formed in which the anchoring element 14 is arranged. The first anchoring part 15 has the groove 23 in which the sealing element 25*a* is arranged, and the sealing element 25*a* is ring-shaped with a trapeze cross-sectional shape. In FIG. 11, the projections 29 are somewhat thicker, i.e. the projections extend more radially outwards as compared to the projections 29 in FIG. 10, and the sealing element 25*a* also extends beyond the spikes of the first anchoring part 15 and the projections 29 in a radial direction perpendicular to the longitudinal extension of the annular barrier 1. In FIG. 12, the expandable metal sleeve 9 also comprises two projections 29 between which the circumferential groove 10 is formed in which the anchoring element 14 is arranged, and the first anchoring part 15 has the groove 23 in which a sealing unit 24*a* is arranged. The sealing unit 24*a* comprises the sealing element 25*a*, made of e.g. elastomer or polymer, a back-up ring-shaped element 26*a* on each side of the sealing element 25*a* and a key ring element 27*a* surrounding part of the back-up ring-shaped element 26*a*. Each anchoring element 14, 14*b* may comprise one sealing unit or several sealing units 24*a*. In FIG. 13, the first anchoring part 15 of the anchoring element 14 has two grooves 23 in which the spring element 22 is arranged in one groove and the sealing element 25*a* in the other. During expansion of the expandable metal sleeve 9, the spring element 22 and the sealing element 25*a* are compressed, and after the expansion has finalised, the spring element 22 and the sealing element 25*a* will slightly decompress due to the small "spring-back effect" following the expansion of metal. The spring element 22 and the sealing element 25*a* are thus always in contact with the wall 5 of the borehole 4, and when the axial load starts, the spring element 22 and the sealing element 25*a* will ensure that the first anchoring part 15 moves along the inclined outer face 18 of the second anchoring part 16, and thus the first anchoring part 15 will be forced radially outwards as illustrated by the dotted lines in FIG. 3. The spring element 22 and the sealing element 25*a* may also be arranged on the inner face 20 of the second anchoring part 16 has two grooves 23.

FIG. 14 shows a perspective of a part of another annular barrier. In order to ensure that the first anchoring part 15 and the second anchoring part 16 of the anchoring element 14 do not slide prematurely in relation to each other, a fixation unit 40 is arranged in the circumferential groove 10, i.e. in the groove 23 of the first anchoring part 15, so that the first anchoring part 15 and the second anchoring part 16 cannot slide in relation to each other. The fixation unit 40 comprises a ring-shaped part 42 extending all the way around the expandable metal sleeve 9, and each end of the ring-shaped part 42 is connected with a breakable element 41. The ring-shaped part 42 is the sealing element 25*a* made of e.g. elastomer or polymer, where the sealing element 25*a* is cut, and each end is connected with a breakable element 41 by means of connection parts 40A, 40B. When expanding the expandable metal sleeve 9, the breakable element 41 breaks, and then the first anchoring part 15 and the second anchoring part 16 are able to slide in relation to each other. The first anchoring part 15 has slits 30 in order to provide a more flexible first anchoring part 15. Instead of the breakable element 41, the connection parts 40A, 40B may also be fastened to the first anchoring part 15 by means of pins 41A, which break during expansion of the expandable metal sleeve 9. In FIG. 15, the breakable element 41 is shown in the position of the pin and is breaking during expansion. The sealing element 25*a* is connected with the breakable element 41 by means of at least one connection part through which the breakable element 41 in the form of a pin extends and extends further into a bore in the first anchoring part 15, forming the fixation unit 40. Once the expandable metal sleeve 9 has expanded and broken, the first anchoring part 15 is free to slide in relation to the second anchoring part 16 when the well tubular metal structure 3 is subjected to the axial load, i.e. an axial movement of the well tubular metal structure 3 in relation to the other well tubular metal structure 3*b*.

As can be seen in FIG. 15, the groove 23 has a first length $L_1$ along the axial extension L, and the first anchoring part 15 has a second length $L_2$ along the axial extension L, where the first length $L_1$ is at least 10% of the second length $L_2$, and preferably at least 20% of the second length $L_2$.

In FIG. 16, the first anchoring part 15 comprises two grooves 23. In the first groove 23, the sealing element 25*a* is arranged circumferenting the expandable metal sleeve 9 and the first anchoring part 15. In the second groove 23 of the first anchoring part 15, the fixation unit 40 is arranged. The second groove 23 does not necessarily extend all the way around the first anchoring part 15. Both grooves 23 have a trapeze cross-sectional shape so that neither the sealing element 25*a* nor the fixation unit 40 are able to move radially outwards and thus out of the groove 23. The fixation unit 40 comprises the breakable element 41 in the form of a breakable pin extending into the first anchoring part 15.

Instead of having a second anchoring element 14*b* as shown in FIG. 1, where the second anchoring element 14*b* is inclined in relation to the axial extension L in an opposite direction than that of the first anchoring element 14, the first anchoring element 14 and the second anchoring element 14*b* are arranged in the same circumferential groove 10, as shown in FIG. 17. The sealing elements 25*a* arranged in each groove 23 of the first anchoring parts 15 face each other, and the second anchoring parts 16 face away from each other. In this way, the annular barrier 1 can easily provide anchoring of the well tubular metal structure 3 in relation to the other well tubular metal structure 3*b* and thus take up the axial load, regardless of whether the movement is upwards or downwards. The first anchoring element 14 and the second anchoring element 14*b* are distanced by a smaller projection than the projections 29 making the circumferential groove 10.

In FIGS. 18A, 18B, the expandable metal sleeve 9 is fastened to the tubular metal part 7 of the well tubular metal structure 3 by means of a connection element 51 which is fastened to the tubular metal part 7 by welded connections 52 and welded to two parts of the expandable metal sleeve 9 by the welded connections 52. The anchoring element 14 is arranged opposite the connection element 51 in the circumferential groove 10 formed by the two parts of the expandable metal sleeve 9 and the connection element 51. During expansion of the expandable metal sleeve 9, the connection element 51 expands as shown in FIG. 18B, pressing the anchoring element 14 radially outwards so as to enhance the function of the anchoring element 14 after expansion has ended. The connection element 51 has a groove 53 in which a projection of the first anchoring part 15 may extend or the groove 53 will make room for welding to provide proper fastening of the first anchoring part 15 to the connection element 51. The expandable metal sleeve 9 is expanded until the sealing units 24, the first anchoring part 15 and the sealing element 25*a* abut the inner face of the other well tubular metal structure 3*b* as shown in FIG. 18B.

FIG. 1 further discloses a downhole completion system 100 comprising the annular barrier 1 and the well tubular metal structure 3 mentioned above.

By "fluid" or "well fluid" is meant any kind of fluid that may be present in oil or gas wells downhole, such as natural gas, oil, oil mud, crude oil, water, etc. By "gas" is meant any kind of gas composition present in a well, completion or open hole, and by "oil" is meant any kind of oil composition, such as crude oil, an oil-containing fluid, etc. Gas, oil and water fluids may thus all comprise other elements or substances than gas, oil and/or water, respectively.

By "casing" or "well tubular metal structure" is meant any kind of pipe, tubing, tubular, liner, string, etc., used downhole in relation to oil or natural gas production.

Although the invention has been described above in connection with preferred embodiments of the invention, it will be evident to a person skilled in the art that several modifications are conceivable without departing from the invention as defined by the following claims.

The invention claimed is:

1. An annular barrier for providing zonal isolation in an annulus downhole between a well tubular metal structure and another well tubular metal structure or a wall of a borehole, comprising:

a tubular metal part configured to be mounted as part of the well tubular metal structure, the tubular metal part having an outer face, an opening and an axial extension along the well tubular metal structure, and an expandable metal sleeve radially surrounding the tubular metal part to define an expandable space that is in fluid communication with an interior portion of the tubular metal part via the opening, wherein the expandable metal sleeve is radially expandable by introducing pressurized fluid into the opening to expand the expandable metal sleeve from a first radial position adjacent the tubular metal part to a second radial position, outwards of the first radial position, in which the expandable metal sleeve contacts the other tubular metal structure or the wall of the borehole, the expandable metal sleeve having a circumferential groove, a first end and a second end, each end of the expandable metal sleeve being connected with the outer face of the tubular metal part, wherein the annular barrier further comprises an anchoring element arranged in the circumferential groove, the anchoring element comprising a first anchoring part at least partly overlapping a second anchoring part in a radial direction perpendicular to the axial extension so that an inner face of the first anchoring part at least partly abuts an outer face of the second anchoring part.

2. An annular barrier according to claim 1, wherein the inner face of the first anchoring part and the outer face of the second anchoring part are inclined in relation to the axial extension.

3. An annular barrier according to claim 1, wherein the first anchoring part forms one monolithic whole, and the second anchoring part forms a second monolithic whole.

4. An annular barrier according to claim 3, wherein the first anchoring part is shaped as a first slit ring, and the second anchoring part is shaped as a second slit ring.

5. An annular barrier according to claim 1, wherein the first anchoring part further comprises an outer face, and the second anchoring part comprises an inner face, the outer face of the first anchoring part comprising friction-enhancing means and facing another well tubular metal structure or the wall of the borehole.

6. An annular barrier according to claim 5, wherein the friction-enhancing means is spikes or grooves.

7. An annular barrier according to claim 4, wherein the outer face of the first anchoring part has at least one groove in which a spring element is arranged.

8. An annular barrier according to claim 5, wherein the inner face of the first anchoring part and the outer face of the second anchoring part have lower friction between them than the friction between the inner face of the second anchoring part and the circumferential groove.

9. An annular barrier according to claim 1, wherein the inner face of the second anchoring part has at least one groove in which a spring element is arranged.

10. An annular barrier according to claim 1, wherein the anchoring element comprises a third anchoring part having an outer face abutting a second inner face of the first anchoring part, so that the first anchoring part is arranged between the third anchoring part and the second anchoring part, and the inner face of the third anchoring part and the inner face of the second anchoring part face and abut the circumferential groove.

11. An annular barrier according to claim 1, further comprising a second anchoring element comprising a first anchoring part at least partly overlapping a second anchoring part in a radial direction perpendicular to the axial extension so that an inner face of the first anchoring part at least partly abuts an outer face of the second anchoring part, the inner face of the first anchoring part and the outer face of the second anchoring part being inclined in relation to the axial extension in an opposite direction than that of the first anchoring element.

12. An annular barrier according to claim 1, wherein the expandable metal sleeve has a second circumferential groove in which a sealing unit is arranged.

13. An annular barrier according to claim 1, wherein the expandable metal sleeve comprises at least two sealing units, and the anchoring element is arranged between two sealing units.

14. Downhole completion system comprising an annular barrier according to claim 1 and a well tubular metal structure.

* * * * *